US006422835B1

(12) United States Patent
Beauchard

(10) Patent No.: US 6,422,835 B1
(45) Date of Patent: Jul. 23, 2002

(54) COMPACT, PORTABLE COMBINATION DUST BLOWING AND SWABBING APPARATUS

(76) Inventor: Roseline Beauchard, P.O. Box 1232, Spring Valley, NY (US) 10977

( * ) Notice: Subject to any disclaimer, the term of this patent is extended or adjusted under 35 U.S.C. 154(b) by 0 days.

(21) Appl. No.: 09/546,938

(22) Filed: Apr. 11, 2000

(51) Int. Cl.[7] ..... F04B 17/60; F04B 35/04; F04B 39/00; A47L 5/24; A47L 5/00

(52) U.S. Cl. ..... 417/411; 417/423.14; 417/434; 15/344; 15/402

(58) Field of Search ..... 417/411, 423.14; 411/234; 15/402, 344, 405, 339

(56) References Cited

U.S. PATENT DOCUMENTS 1,108,053 A * 8/1914 Wiwi et al. ..... 417/411
1,694,257 A * 12/1928 Hagopian ..... 15/395
2,465,554 A * 3/1949 Roy ..... 230/217
3,967,341 A * 7/1976 Gavin ..... 15/345
4,635,382 A * 1/1987 Bourdeau ..... 126/401
4,734,017 A * 3/1988 Levin ..... 417/366
4,800,654 A * 1/1989 Levin et al. ..... 126/401
4,903,416 A * 2/1990 Levin et al. ..... 126/401
4,945,604 A * 8/1990 Miner et al. ..... 15/344
4,989,292 A * 2/1991 Hwang ..... 15/344
5,228,022 A * 7/1993 Compton et al. ..... 15/347
5,401,328 A * 3/1995 Schmitz ..... 134/103.2
5,498,134 A * 3/1996 Ibekwe ..... 416/142
5,667,732 A * 9/1997 Lederer ..... 239/222.11
5,774,933 A * 7/1998 Jannicelli, Jr. ..... 15/398
5,833,534 A * 11/1998 Lai ..... 362/191
5,837,167 A * 11/1998 Lederer ..... 239/289
5,938,410 A * 8/1999 Lee ..... 417/234

* cited by examiner

*Primary Examiner*—Charles G. Freay
*Assistant Examiner*—Timothy P. Solak
(74) *Attorney, Agent, or Firm*—John D. Gugliotta

(57) ABSTRACT

A combination dust blowing and swabbing apparatus is provided having a cylindrical housing having an outer surface and a fan exit nozzle and a fan housed within the fan exit nozzle. A fan inlet nozzle formed by and penetrating the outer surface of the housing is positioned also at the same end of the cylindrical housing as said exit nozzle but positioned to allow the fan to be placed between the fan inlet nozzle and the exit nozzle.

4 Claims, 3 Drawing Sheets

COMPACT, PORTABLE COMBINATION DUST BLOWING AND SWABBING APPARATUS

BACKGROUND OF THE INVENTION

1. Field of the Invention

The present invention relates generally to hand held dusting fans and, more particularly, to a compact fan that combines dusting, blowing, and swabbing functions into one portable hand held apparatus.

2. Description of the Related Art

While no one will question the usefulness and convenience of such consumer electronic devices, such as VCR's, stereos, computers and the like, they all suffer from one common drawback. That drawback is the difficulty encountered in keeping them all clean. It is almost impossible to use a dustcloth on such items, like one would use on furniture items due to the many cracks and crevices common to such devices. Brushes and other cleaning devices are also equally uneffective due to their limited reach and ineffectiveness at cleaning large, flat surfaces. If water or other liquid-based cleaners are used, one runs the risk of electrocution or possible damage to plastic components due to the use of some cleaning chemicals.

One method of cleaning such devices in the past has been through the use of compressed air in a can. While such cleaning methods do work, repeated use, especially on a weekly basis, would soon become cost prohibitive due to the cost per can of compressed air, and the amount of air that must be used each time.

In the related art other hand held fan combinations are known. For example, in U.S. Pat. No. 5,837,167 issued in the name of Lederer and U.S. Pat. No. 5,667,732 issued in the name of Lederer a compact, portable misting fan garnering power from batteries is disclosed.

Also, the following patents describe a hand-held electric fan/hair dryer:

U.S. Pat. No. 5,498,134 issued in the name of Ibekwe;

U.S. Pat. No. 4,903,416 issued in the name of Levin et al.;

U.S. Pat. No. 4,800,654 issued in the name of Levin et al.; and

U.S. Pat. No. 4,635,382 issued in the name of Bourdeau.

U.S. Pat. No. 5,833,534 issued in the name of Lai discloses a combination electric fan and flashlight removably mounted to a bicycle.

U.S. Pat. No. 5,401,328 issued in the name of Schmidtz describes a device for cleaning appliances using cleaning liquids ventilated by means of a fan.

U.S. Pat. No. 5,228,022 issued in the name of Compton et al. discloses a battery-operated compact disk cleaner with brushes and a fan.

And finally, U.S. Pat. No. 4,989,292 issued in the name of Hwang describes a small dust catcher including a fan, motor, and battery case.

Accordingly, there is a need for a means by which air movement can be used to clean sensitive electronic items without the dangers or risk of damage associated with liquid cleaners and the cost associated with compressed air in cans.

SUMMARY OF THE INVENTION

It is therefore an object of the present invention to provide an improved apparatus for dusting and cleaning sensitive electrical appliances.

It is another object of the present invention to provide such an apparatus that provides for forced air dusting in combination with swab dusting.

There are features of the present invention to provide such an apparatus which is hand held and portable.

It is a feature of one embodiment of the present invention to be portable battery operated.

It is a feature of another embodiment of the present invention to be electrically powered, utilizing a power cord for its electrical supply.

Briefly described according to the preferred embodiment of the present invention, the overall shape of the invention is tube-like with a direct current fan mounted on the inside of the tube along with "D"-size dry cell batteries and an on/off switch. In an alternate embodiment, a power cord is provided to an alternating current fan mounted inside the tube. Air is pulled through the tube by the fan and discharged through one end of the invention. That same end of the invention is also equipped with cotton-covered leather fringes to aid in the cleaning process. It is envisioned that the fringes would flutter in the air path and dislodge any dust on the surface to be cleaned. The blowing air would then carry the same dust away. The invention is also equipped with an extension wand mounted on a pivot point, and a narrow nozzle for getting into small locations.

The use of the present invention allows for cleaning sensitive electronic devices, where harsh cleaning chemicals or hard physical contact could damage such items.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENTS ACCORDING TO THE FIGURES

1. Detailed Description of the Figures

Figure 1A:
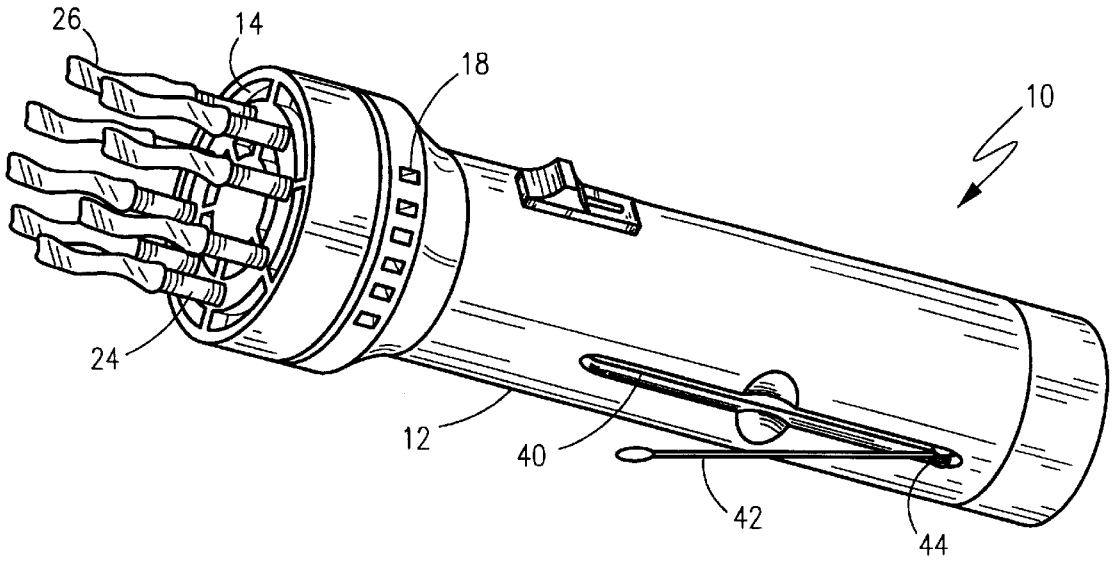
FIG. 1*a* is an orthographic view of a compact, portable combination dust blowing and swabbing apparatus according to the preferred embodiment of the present invention described.
Figure 1B:
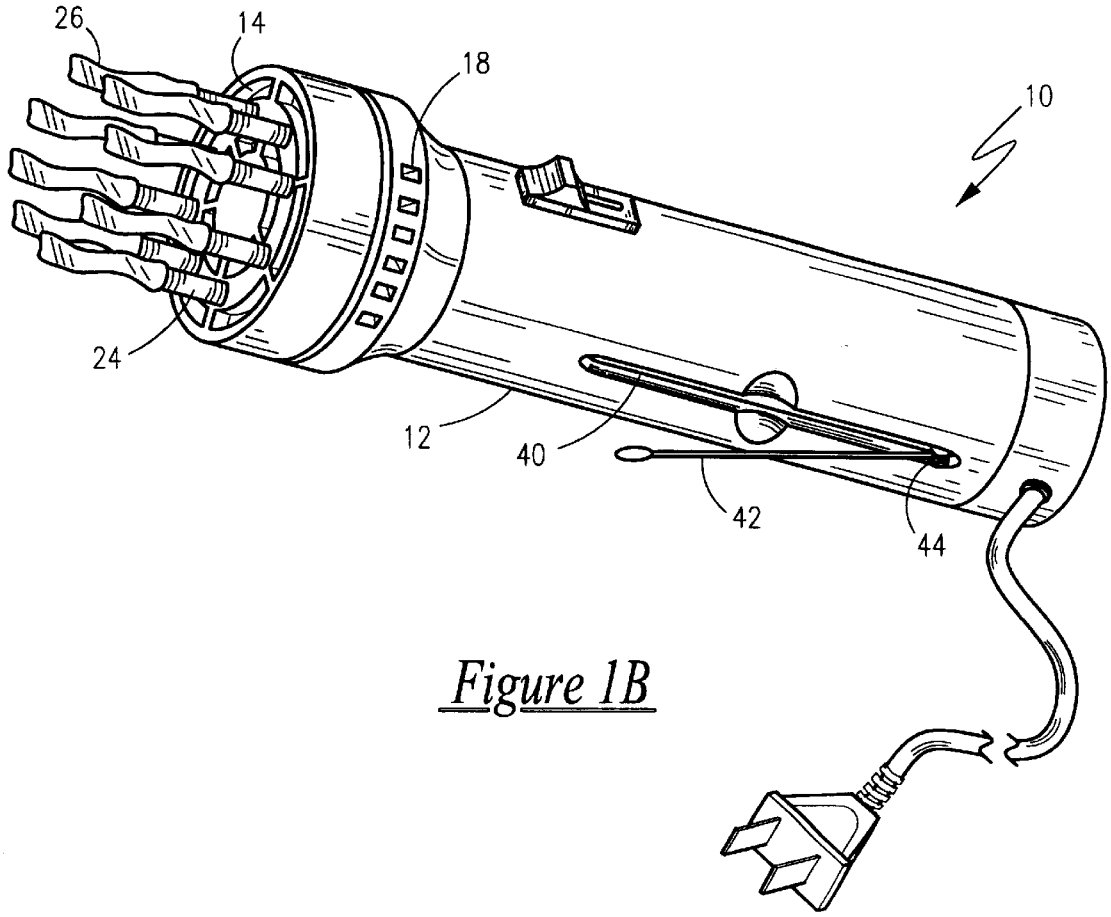
FIG. 1*b* is an orthographic view of an alternate embodiment thereof powered by alternating current.

Referring now to FIG. 1, a compact, portable combination dust blowing and swabbing apparatus 10 is shown, according to the present invention, comprising generally a cylindrical housing 12 having a fan exit nozzle 14 at one end. Housed within the exit nozzle end is a fan 20, as will be described in further detail below. Further formed by and penetrating the outer surface of the housing 12 is a fan inlet nozzle 18, shown herein as a horizontally disposed, rectangular louvered vent. The inlet nozzle 18 is positioned also at the same end of the cylindrical housing 12 as the exit nozzle 14, but positioned as such to allow the fan 20 to be placed between the inlet nozzle 18 and the exit nozzle 14 along the linear centerline of the housing 12.

Figure 3:
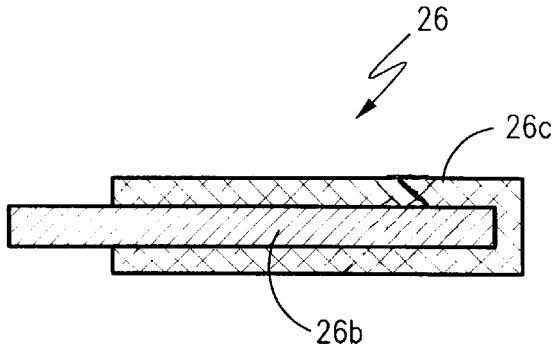
FIG. 3 is a cross sectional view of a fringe brush element 26 for use with the present invention.
Figure 4:
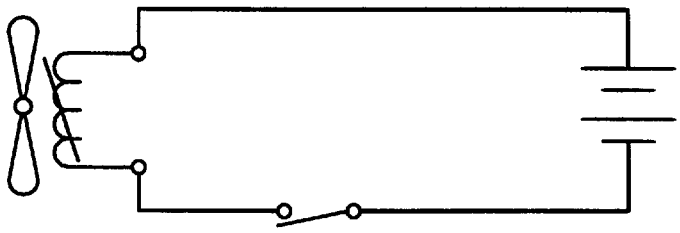
FIG. 4 is an electrical schematic of the direct current control circuit according to the preferred embodiment of the present invention.

Positioned about the circumference for the fan exit nozzle 14 are a series of gripping tines 24. Each gripping tine 24 supports a fringe brush element 26. As best disclosed in conjunction with FIG. 3, each fringe brush element 26 is formed of a rectangular central layer 26*b* formed of leather or other pliable but durable material, with an outer layer 26*c* on each side of cotton or other soft, absorbent material.

Further formed within the outer sidewall of the cylindrical housing 12 is a swab receiving cavity 40. The swab receiving cavity 40 is formed recessed into the outer surface of the housing 12, and is form in a rectilinear shape to receive a linearly elongated swab member 42. The swab member 42 is thereby secured to the housing 12 at one end of the swab receiving cavity 40 by a swab member pivot 44. In this manner, the swab member 42 can be deployed outward in a pivoting manner, or alternately nested within the swab receiving cavity 40.

Figure 2:
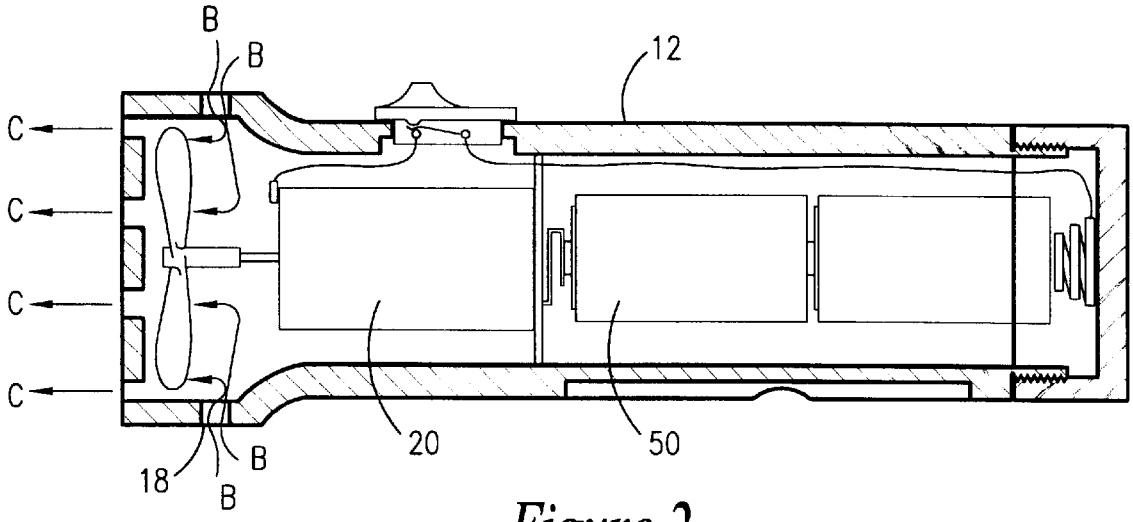
FIG. 2 is a cross sectional view thereof taken along the lines II—II of FIG. 1.

FIG. 2 shows a cross-sectional view of the compact, portable combination dust blowing and swabbing apparatus 10 drawn along line Ill—III in FIG. 2. The housing 12 not only forms a plurality of inlet vent structures 18, but also contains a fan unit 20. The fan unit 20 is operated from batteries 50 in a conventional manner. Alternately, the fan unit 20 can be supplied alternating current by a power cord 21 in a conventional manner. In either embodiment, the fan unit 20, when engaged, draws ventilation air in through the plurality of inlet vent structures 18, and out through the exit fan nozzle 14, as shown by directional lines B–C.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A combination dust blowing and swabbing apparatus comprising:

a cylindrical housing having an outer surface and a fan exit nozzle;

a fan housed within said fan exit nozzle;

a fan inlet nozzle formed by and penetrating the outer surface of the housing, said fan inlet nozzle positioned also at the same end of said cylindrical housing as said exit nozzle but positioned as such to allow said fan to be placed between said fan inlet nozzle and said exit nozzle along a linear centerline of said housing;

a series of gripping tines positioned about the circumference of said fan exit nozzle, each said gripping tine supporting a fringe brush element, wherein each fringe brush element is formed of a rectangular central, with an outer layer on each side of a soft, absorbent material; and a swab receiving cavity within the outer sidewall of said cylindrical housing, said swab receiving cavity formed recessed into the outer surface of the housing in a rectilinear shape to receive a linearly elongated swab member, said swab member thereby secured to the housing at one end of the swab receiving cavity by a swab member pivot.

2. The combination dust blowing and swabbing apparatus of claim 1, wherein said fan inlet nozzle comprises a horizontally disposed, rectangular louvered vent.

3. The combination dust blowing and swabbing apparatus of claim 1, wherein said fan is operated from batteries.

4. The combination dust blowing and swabbing apparatus of claim 1, wherein said fan is supplied alternating current by a power cord.

* * * * *